United States Patent [19]

Dietrich

[11] 4,122,777

[45] Oct. 31, 1978

[54] RAILWAY MAINTENANCE CAR

[75] Inventor: Udo Dietrich, Gevelsberg, Germany

[73] Assignee: Demag A.G., Duisburg, Germany

[21] Appl. No.: 759,538

[22] Filed: Jan. 14, 1977

[30] Foreign Application Priority Data

Jan. 17, 1976 [DE] Fed. Rep. of Germany ..... 2601593

[51] Int. Cl.[2] ..... B61B 3/00

[52] U.S. Cl. ..... 104/89; 104/20; 105/148; 105/457; 214/83.24

[58] Field of Search ..... 104/20, 21, 28–31, 104/89, 118; 105/141, 148, 150, 425, 457, 460; 214/83.24, 730; 212/73, 74

[56] References Cited

U.S. PATENT DOCUMENTS

| | | | |
|---|---|---|---|
| 1,016,926 | 2/1912 | Armstrong | 105/457 |
| 1,614,769 | 1/1927 | Amsler | 212/73 |
| 3,294,267 | 12/1966 | Schweigert | 214/83.24 |
| 3,484,002 | 12/1969 | Barry | 104/20 |
| 3,490,622 | 1/1970 | Brackin | 212/74 |
| 3,823,671 | 7/1974 | Straumsnes | 104/20 |
| 3,929,077 | 12/1975 | Benndahl | 105/150 |

FOREIGN PATENT DOCUMENTS

| | | | |
|---|---|---|---|
| 405,996 | 4/1974 | U.S.S.R. | 105/148 |

*Primary Examiner*—Robert G. Sheridan
*Assistant Examiner*—Carl Rowold
*Attorney, Agent, or Firm*—Mandeville and Schweitzer

[57] ABSTRACT

A railway maintenance car is provided for elevated railways which uses the rails, or rail of a monorail system, to move to the place of maintenance, thus avoiding obstruction of ground areas beneath the railway. The car of the invention includes telescoping cantilevered maintenance access platforms movable laterally and longitudinally of the car to place maintenance personnel alongside stalled cars on the rail or rails, and to move such personnel under the rail itself for maintenance and repair. The telescoping features of the invention include independently operable devices at each end of a telescoping platform in order to extend such platforms at an angle to the axis of the car for accommodating curved rail access.

12 Claims, 10 Drawing Figures

RAILWAY MAINTENANCE CAR

BACKGROUND AND STATEMENT OF THE INVENTION

The invention relates to a maintenance car for an elevated train. Elevated trains, up to the present time, have no special maintenance cars. Street vehicles have been used for maintenance, where the maintenance platform can be raised on a telescopic column. Such maintenance cars, however, can only be utilized on streets and other locations accessible to cars, not above rivers, houses, railroads, or in impassable terrain. The known maintenance cars hinder traffic in the street during their operation. It is also impossible to tow broken-down cars on rails with cars running in the street.

It is the object of the present invention to design a maintenance car operating in all areas of an elevated train. This is done by having the maintenance car run on the rail (generally, a monorail) of the elevated train, and by providing it with a maintenance platform extendible beyond the base of the maintenance car. This type of maintenance car can go to any location without hindering street traffic, and at its destination the maintenance platform is brought into position for the necessary maintenance work. If maintenance is required on the rail, only lateral or side extension of the maintenance platform is necessary to permit such procedure. It is, however, also possible to rescue people from cars which cannot move due to certain damage. For this purpose, the maintenance car is provided with a platform extension extendible longitudinally which is brought into position next to the inoperable car. If inoperable cars cannot be put back into service on the spot, the maintenance car can tow them.

The maintenance platform may be arranged below the bottom or on the roof of the maintenance car cabin. If it is located under the bottom of a suspended type maintenance car which is suspended from the rail, construction is simplified, as the mobility of the platform is not limited by the undercarriage of the maintenance car. The platforms in suspended maintenance cars are, furthermore, better suited for service to be performed at the rail. The maintenance car may be equipped with one maintenance platform below the bottom, as well as one on the roof, whereby the latter may be of simple construction and extendible by hand.

A further detail of the invention provides each end of the maintenance car with a cross rail on which a cross carrier travels, which supports the maintenance floor. Tilt guards may be placed between cross rail and cross travel carrier which guard against tilting of the extended service floor against the maintenance car. Preferably, the travelling cross carrier accommodates a travelling cross carriage to which the service floor is attached. In this fashion, further extension of the service floor, laterally from the maintenance car, is achieved.

The cross carrier consists, preferably, of a box-like profile and the center of the profile is provided with a lower longitudinal slot for establishing a connection between cross carriage and service floor, whereby the longitudinal slot is bounded by stays pointing down and forming guide faces, while opposing flanges follow the lower end of such stays. The lower flanges contribute to the increase in bending strength of the cross carrier. The bottom of the box-like profile forms raceways next to the stays for rollers running on the rail and carrying the cross carrier. The inside of the box-like cross carrier bottom forms runways for the cross carriage. Thus practically all surfaces of the cross carrier are used as runways and guide faces for extending the service platform.

In another detail of the invention each cross rail comes with a displacement motor which drives a chain engaging at fixed points at the ends of the cross carrier via a drive gear, and each end of the cross carriage is provided with engaging points for additional chains which lead to a fixed point at the cross rail around guide wheels arranged at the ends of the cross carrier. Thus, when extending the cross carrier, the cross carriage travels simultaneously in the cross carrier. The displacement motors of front and rear cross carriers are independently controlled and the cross carriers and consequently the cross carriers can be extended to various lengths.

This is important when utilizing an additional platform extension extendible in longitudinal direction; details of such extension will be given later on. If the platform extension must be positioned next to a broken-down rail car in a curve of the rail, the cross carriages must be extended to different lengths to adapt the platform extension to the bend of the rail. In order to facilitate such differential extension of the cross carriers, the maintenance floor is provided with at least one length compensation slot through which penetrates the cross carriage with a floor suspension equipped with wheels for the maintenance floor. The length compensation slot runs in longitudinal direction of the maintenance floor, and is long enough to compensate for maximum extension direction of the maintenance floor versus the maintenance car.

A further detail of the invention provides the maintenance platform with a maintenance floor with a platform extension movable in the floor longitudinal beams. The floor longitudinal beams of the maintenance floor are connected via cross beams above and below the platform extension, so that the maintenance floor surrounds the platform extension like a box, and the floor longitudinal beams of the maintenance floor are safeguarded against tilting. At the floor longitudinal beams, support rolls revolve around horizontal roll axles, and guide rolls revolve around vertical roll axles, resting on horizontal runways and vertical guide faces of the platform extension. The runways consist of horizontal flanges and the guide faces of stays of two platform extension longitudinal beams.

A platform motor is attached to one of the floor longitudinal beams, whose drive gear engages with a chain which leads around guide wheels arranged at the ends of the floor longitudinal beam and from there to fixed points arranged at the opposite ends of the platform extension. In this arrangement, the chain crosses and permits extension of the platform extension from the floor longitudinal beams as far as made possible by the guide. Being that the maintenance car is longer than the regular rail car, sufficient guide length is guaranteed for the platform extension at the floor longitudinal beams.

A railing may be mounted on the maintenance platform. To this end the edge of the maintenance floor and platform extension is provided with tubular railing brackets into which railing posts are inserted. After extension of the maintenance floor and/or platform extension the railing posts are inserted into the tubular railing brackets. The actual railing consists of a chain, a rope, or a lattice. Furthermore, a folding ladder is attached to the maintenance floor. In the case of suspended maintenance cars, the ladder is located on top of the maintenance platform and folded upward for services to be performed on the rails and/or rail car on the rail. For maintenance cars running on rails rather than being suspended, the ladder is arranged below the maintenance floor and folds out below.

The maintenance car has a current accumulator consisting of a battery which provides the displacement motor, the extension motor and the drive motor of the maintenance car with electric current during power failure. In order to keep the current accumulator and thus the weight of the maintenance car as small as possible, a combustion motor is provided as well which can supply energy for a prolonged period of time. For a further understanding of the invention reference is made to the drawings and the following detailed description illustrating an embodiment of the invention in the form of a suspended maintenance car in an elevated monorail system, although it will be understood that the invention may be utilized with cars operable on the rail, and that the invention is useful in dual rail systems as well.

DETAILED DESCRIPTION OF A PREFERRED EMBODIMENT

Figure 1:
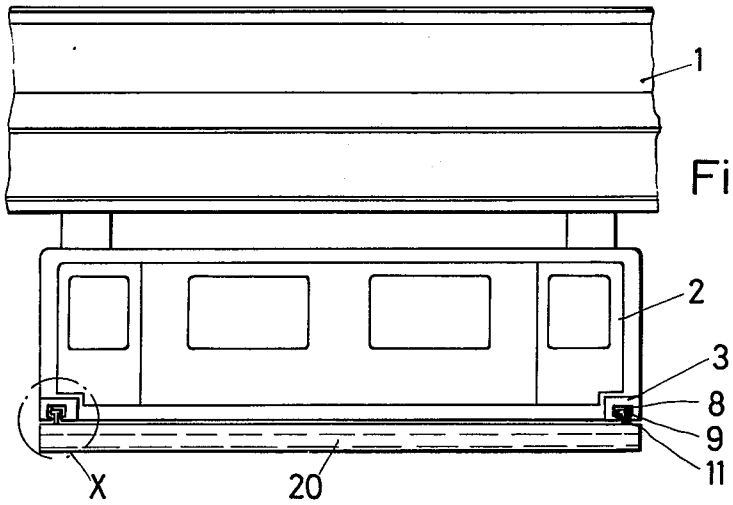
FIG. 1 is a side elevational view of suspended maintenance car embodying the invention.
Figure 2:
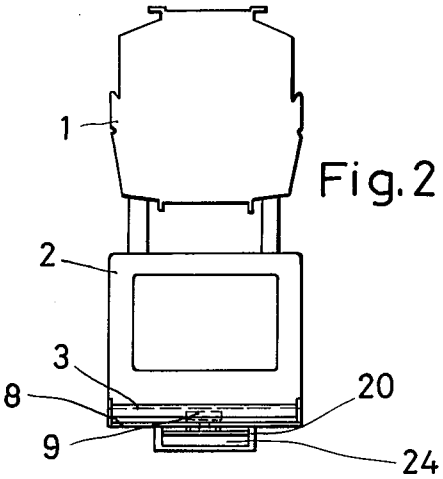
FIG. 2 is an end view of the car of FIG. 1.
Figure 3:
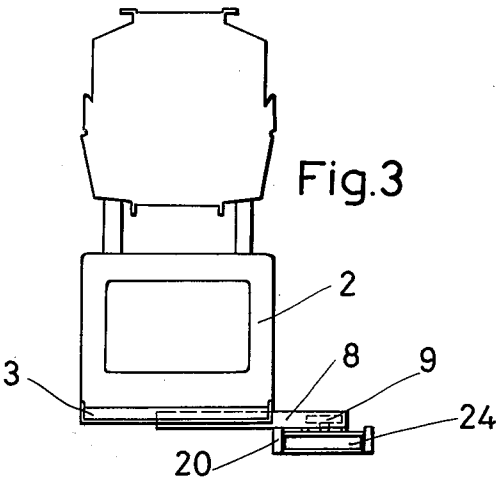
FIG. 3 is the same view as FIG. 2, but with the maintenance platform laterally extended.

FIG. 1 shows rail 1 with suspended maintenance car 2, provided with one cross rail 3 each at the front and rear for cross travelling carrier 8 with cross carriage 9 equipped with platform suspension 11 for maintenance floor 20. FIG. 2 shows cross rail 3 with cross carrier 8 and cross carriage 9 with maintenance floor 20 containing platform extension 24 in travelling position. In FIG. 3, cross carrier 8 with cross carriage 9 and maintenance floor 20 including platform extension 24 is in lateral position next to maintenance car 2.

Figure 4:
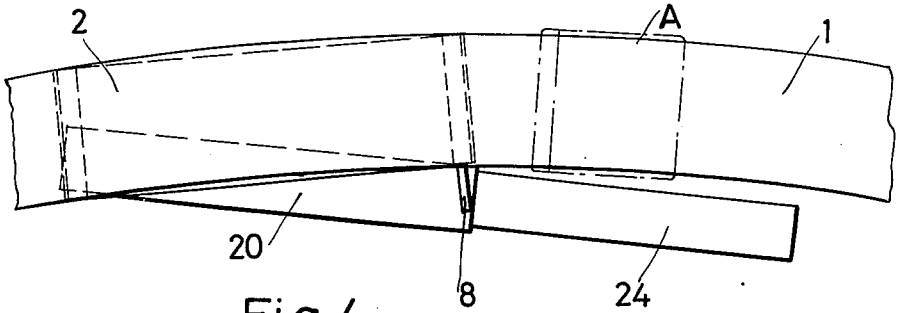
FIG. 4 is a top plan view showing the positioning of the maintenance car of the invention and its platform extended longitudinally to gain access on a curve.
Figure 5:
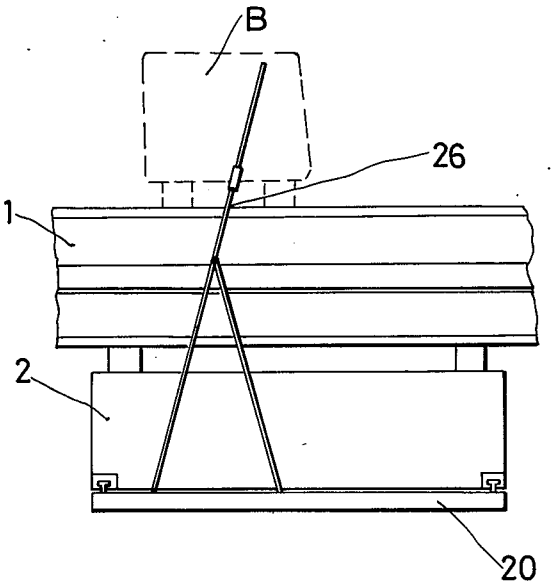
FIG. 5 is a side elevational view of a maintanance car embodying the invention and illustrating the placement of an access extension ladder to gain access to a stalled railway car.

FIG. 4 shows a curved rail 1 with rail car A in dot-dash lines, next to which is positioned platform extension 24 extended from maintenance floor 20. Each end of maintenance floor 20 is extended to different lengths from maintenance car 2 via cross carriers 8, so that platform extension 24 is parallel with rail car A, thus permitting passengers to leave rail car A and, also facilitating repair of the latter. FIG. 5 shows maintenance car 2 suspended from rail 1 with ladder 26 on maintenance floor 20 to aid in the rescue of passengers from rail car B on rail 1, indicated in dot-dash lines.

Figure 6:
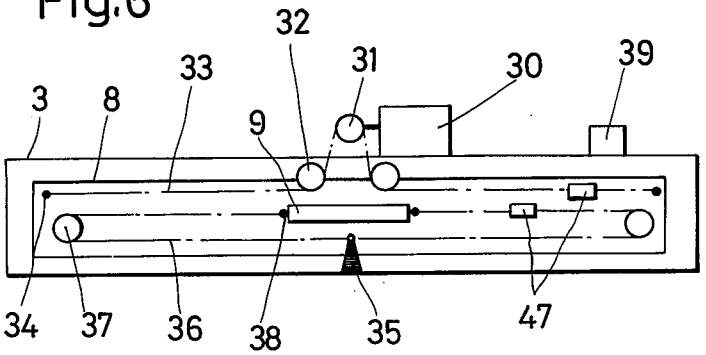
FIG. 6 is a diagrammatic illustration of the arrangement of the invention for telescoping lateral movement of the maintenance access platform.

FIG. 6 shows schematically cross rail 3 of the maintenance car with the drive for cross carrier 8. Displacement motor 30 with drive gear 31 for chain 33 is attached to cross rail 3. Near drive gear 31 chain 33 goes around pinions 32, and is attached at the ends to fixed points 34 at the ends of cross carrier 8. At the ends of this cross carrier 8, guide wheels 37 are attached for additional chain 36, whose fixed point 35 is attached to cross rail 3, and whose ends engage with engaging point 38 at cross carriage 9. When moving the cross carrier 8 by means of displacement motor 30, the guide wheels 37 are moved as well, and chain 36 then pulls cross carriage 9 across guide wheels 37 at twice the speed of cross carrier 8. Chains 33 and 36 are equipped with chain tighteners 47. Furthermore, cross rail 3 comes with terminal switch 39.

Figure 7:
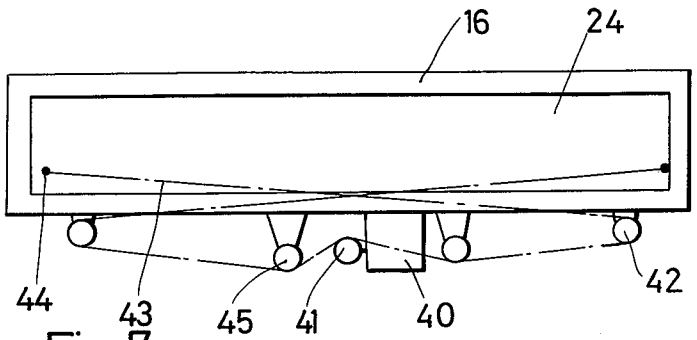
FIG. 7 is a diagrammatic illustration of the arrangement of the invention for telescoping longitudinal movement of the maintenance access platform.

FIG. 7 shows floor longitudinal beam 16 with attached extension motor 40 with drive gear 41 to drive chain 43 for extension of platform extension 24. Chain 43 partially embraces drive gear 41 due to the arrangement of hold-down wheels 45, and leads around guide wheels 42 to fixed points 44 at the opposite ends of platform extension 24. Crossing chain 43 permits lateral movement of platform extension 24, until left fixed point 44, for example, is almost above right guide wheel 42.

Figure 8:
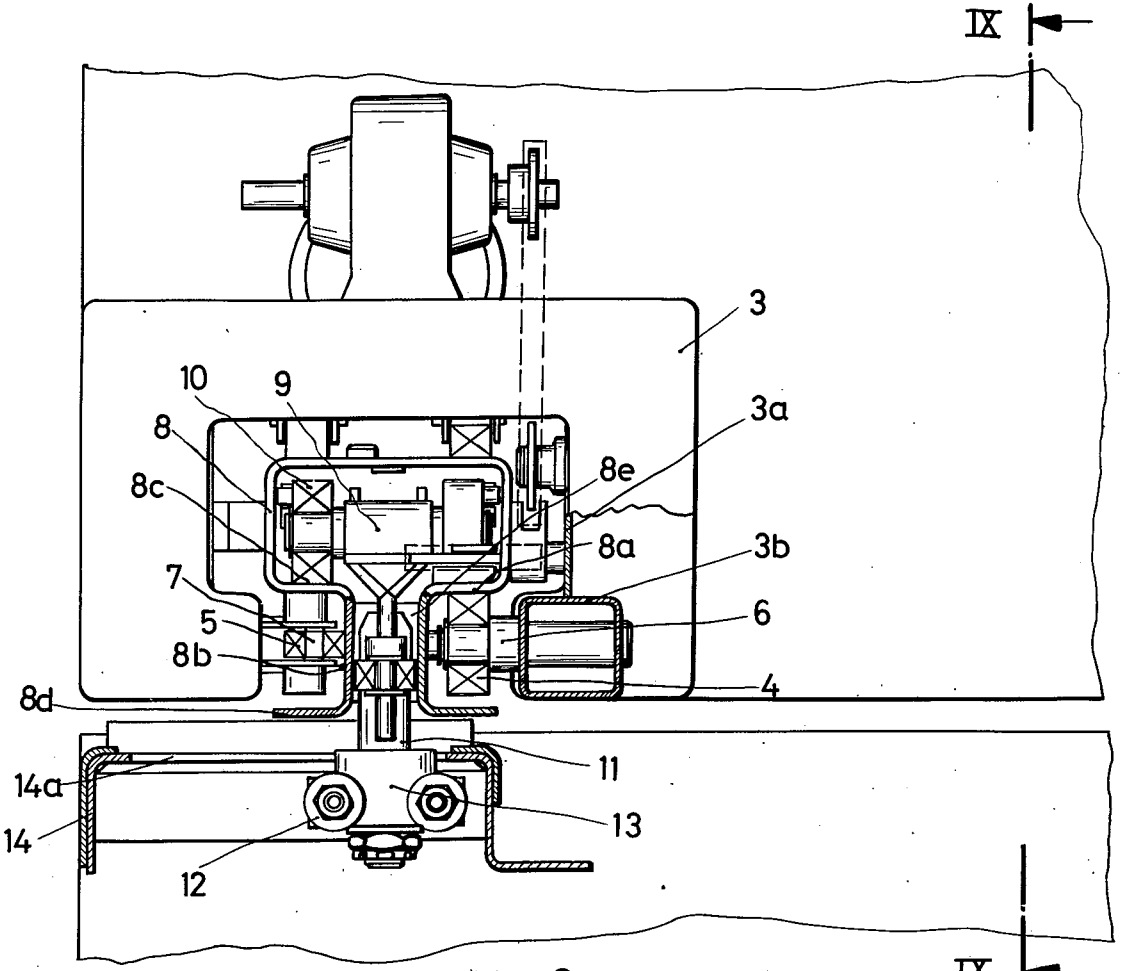
FIG. 8 is an enlarged view in detail of the area marked X in FIG. 1.

FIG. 8 shows a cross section of cross rail 3 with its cross carrier 8 which, in turn, accommodates cross carriage 9 travelling on wheels 10. Cross rail 3 is a U-profile open towards the borollers 4 on runways 8*a* which are formed on cross carrier 8 by the bottom surface of a profile part roughly box-shaped in cross section. Runways 8*a* arranged on both sides are connected to vertical guide faces 8*b* for guide rollers 5. Cross carrier 8 is provided, below guide faces 8*b*, with flanges 8*d* facing away from each other.

Box-shaped cross carrier 8 has, above runways 8*a*, runways 8*c* for wheels 10 of cross carriage 9, which extends with floor suspension 11 between the two guide faces 8*b* forming longitudinal slot 8*e*, and which has a rotary bearing 13 with floor support rollers 12. The floor suspension also extends through a length compensation slot 14*a* of upper floor cross beam 14 resting on floor support rollers 12. Elongated slot 14*a* crosses floor cross beam 14 in longitudinal direction of maintenance car 2, and facilitates differing distance lateral movements between the front and rear of cross carriage 9.

Figure 9:
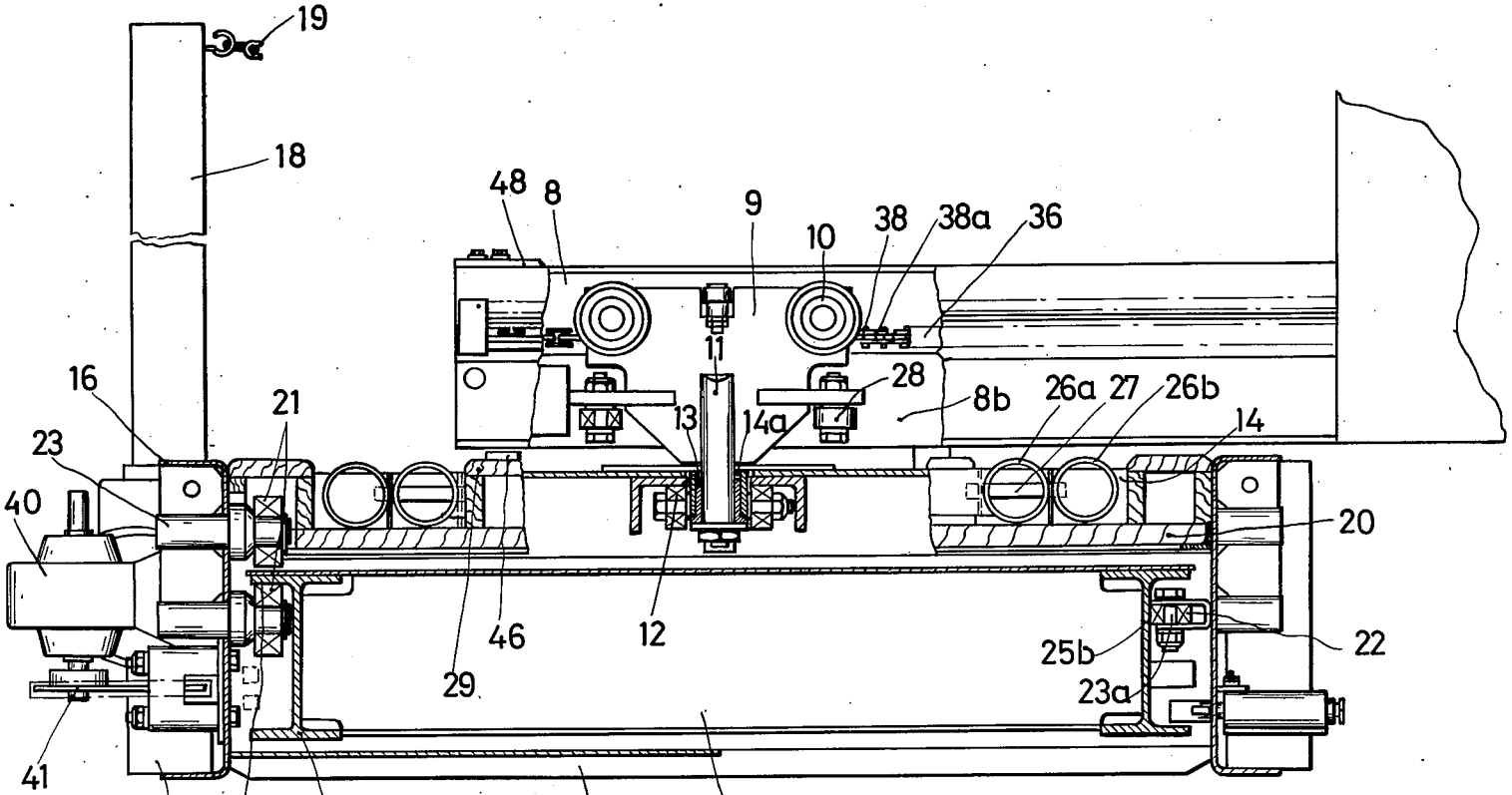
FIG. 9 is a cross sectional view along lines IX—IX of FIG. 8.

FIG. 9 shows cross carriage 9 with its wheels 10 in profile, as well as attachment of chain 36 to engaging points 38 by means of chain lock 38*a*. Furthermore, between guide faces 8*b* of cross carrier 8, roller guides 28 and length compensation slot 14*a* in floor cross beam 14 can be seen, which rests on floor support rollers 12 of cross carriage 9. Floor suspension 11 carrying rotary bearing 13 extends through length compensation slot 14*a*. Tilting of floor beam 14 versus cross carrier 8 is prevented by tilt guards 46 located between the two parts and attached to floor plate 29.

FIG. 9 shows a cross section of maintenance floor 20, with platform extension 24 arranged in the maintenance floor 20. The two U-shaped floor longitudinal beams 16 are connected via upper floor cross beam 14, and are prevented from tilting by lower floor cross beam 15.

Floor longitudinal beam 16 is equipped with tubular railing brackets 17 for railing posts 18 carrying a railing 19 in the form of a chain on top. The tubes of folded ladder 26 are inserted into bottom plate 29 of maintenance floor 20. Ladder rung 26a is attached to floor cross beam 14 via ladder bolt 27. Ladder support 26b can be inserted into guide boreholes which are not shown, when the ladder is in operating position.

At floor longitudinal beam 16, support rollers 21 revolving around horizontal axles 23, and guide rollers 22 revolving around vertical axles 23a are arranged, which rest on runways 25a and/or guide faces 25b of I-shaped platform extension longitudinal beam 25. Floor longitudinal beam 16 comes attached with extension motor 40 provided with drive gear 41.

Figure 10:
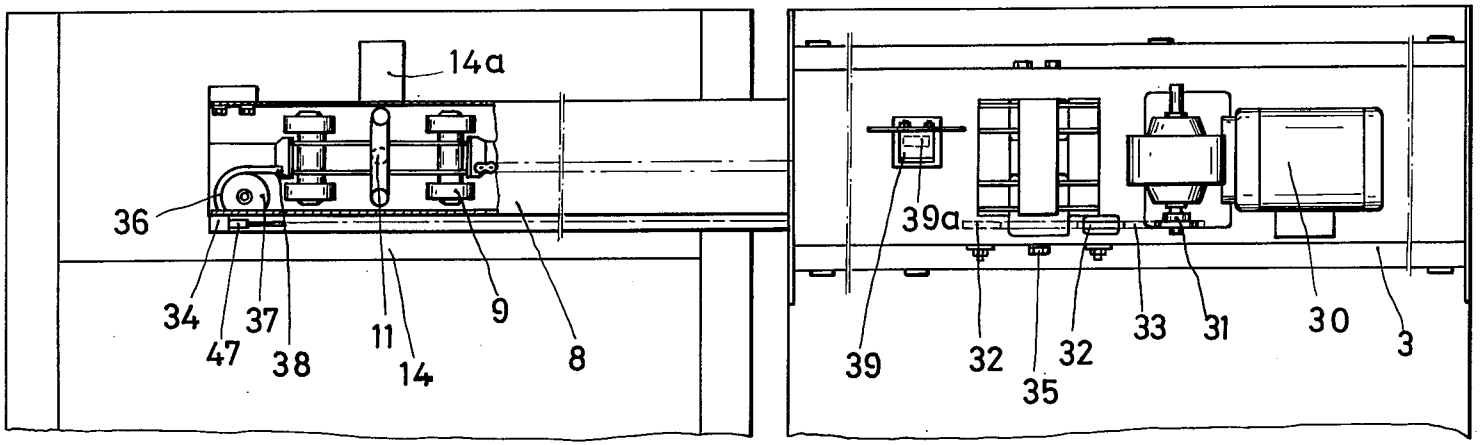
FIG. 10 is a top plan view of the device shown in FIG. 9.

FIG. 10 shows cross carriage 9 in plan view in cross carrier 8, as well as the arrangement of displacement motor 30 at cross rail 3. Chain 33 driven by drive gear 31 of displacement motor 30 goes around pinons 32 to fixed points 34, one of which is equipped with chain tightener 47. FIG. 10 also shows the guiding of chain 36 from fixed point 35 of cross rail 3 via guide wheels 37 to engaging points 38 at cross carriage 9. Terminal switch 39 is attached to cross rail 3 and protrudes into cross rail 3 with its switch roller 39a causing turn-off of displacement motor 30 after contact with switch cam 48 attached to cross carrier 8, and indicated on FIG. 9. Cross carriage 9 extends with its floor suspension 11 into length compensation slots 14a of upper floor cross beam 14 running in travel direction.

I claim:

1. Maintenance apparatus for elevated railways, comprising (a) an elevated rail right of way;
(b) a maintenance car for said rail right of way; characterized by
(c) said maintenance car operable on said rail right of way;
(d) a transverse rail disposed on each end of said car;
(e) a cross carrier movable on said transverse rails;
(f) a maintenance access platform extendable from said cross carrier for moving personnel adjacent an area to be repaired and maintained;
(g) a maintenance floor on said platform;
(h) a longitudinal slot in said floor;
(i) a floor suspension disposed on said cross carrier;
(j) said floor suspension extending through said maintenance floor slot;
(k) rollers on said floor suspension; and
(l) said floor supported on said suspension rollers.

2. Maintenance apparatus for elevated railways, comprising (a) an elevated rail right of way;
(b) a maintenance car for said rail right of way;
(c) said maintenance car operable on said rail right of way;
(d) a transverse rail disposed on each end of said car;
(e) a cross carrier movable on said transverse rails;
(f) a maintenance access platform extendable from said cross carrier for moving personnel adjacent an area to be repaired and maintained;
(g) spaced-apart longitudinal supporting beams on said platform;
(h) a platform maintenance floor disposed on said beams;
(i) a platform extension movably disposed on said platform between said beams; and
(j) crossbeams extending between said longitudinal beams above and below said movable platform extension.

3. The apparatus of claim 2, further characterized by (a) tilt guards disposed between each transverse rail and said cross carrier.

4. The apparatus of claim 2, further characterized by (a) said cross carrier is substantially box shaped in profile;
(b) the lower end of said cross carrier including a pair of spaced apart opposed downwardly extending L-shaped flanges; and
(c) the opposed faces of said flanges forming a longitudinal slot.

5. The apparatus of claim 4, further characterized by (a) each of said transverse rails including rollers with horizontal axes disposed thereon;
(b) the bottom surfaces of said box-shaped cross carrier forming opposed horizontal bearing surfaces for said cross rail rollers; and
(c) said bearing surfaces being adjacent said L-shaped flanges.

6. The apparatus of claim 4, further characterized by (a) the inner bottom surface of said box-shaped cross carrier forming opposed second bearing surfaces; and
(b) said second bearing surfaces forming runways for said cross carriage.

7. The apparatus of claim 2, further characterized by (a) a pair of movable platform extension longitudinal supporting beams;
(b) said movable platform extension supporting beams being I beams; and
(c) said vertical and horizontal roller engaging surfaces on said I beams.

8. The apparatus of claim 2, further characterized by (a) a guard rail attached to said maintenance access platform.

9. Maintenance apparatus for elevated railways, comprising (a) an elevated rail right of way;
(b) a maintenance car for said rail right of way;
(c) said maintenance car operable on said rail right of way;
(d) a transverse rail disposed on each end of said car;
(e) a cross carrier movable on said transverse rails;
(f) a maintenance access platform extendable from said cross carrier for moving personnel adjacent an area to be repaired and maintained;
(g) spaced-apart longitudinal supporting beams on said platform;
(h) a platform maintenance floor disposed on said beams;
(i) a platform extension movably disposed on said platform between said beams;
(j) a plurality of rollers with horizontal axes disposed upon said spaced-apart longitudinal supporting beams;
(k) a plurality of rollers with vertical axes disposed upon said spaced-apart longitudinal supporting beams; and
(l) said movable platform extension having horizontal and vertical roller engaging surfaces for engaging said plurality of rollers with vertical and horizontal axes.

10. Maintenance apparatus for elevated railways, comprising (a) an elevated rail right of way;

(b) a maintenance car for said rail right of way;
(c) said maintenance car operable on said rail right of way;
(d) a transverse rail disposed on each end of said car;
(e) a cross carrier movable on said transverse rails;
(f) a maintenance access platform extendable from said cross carrier for moving personnel adjacent an area to be repaired and maintained;
(g) spaced-apart longitudinal supporting beams on said platform;
(h) a platform maintenance floor disposed on said beams;
(i) a platform extension movably disposed on said platform between said beams;
(j) an extension motor disposed on one said spaced-apart platform longitudinal beams;
(k) guide wheels disposed at each end of said platform longitudinal support beam;
(l) a chain engaging said extension motor and said guide wheels; and
(m) the ends of said chain fixed to opposite ends of said movable platform extension.

11. The apparatus of claim 10, further characterized by
(a) a plurality of spaced tubular railing brackets disposed on said platform and said platform extension;
(b) railing posts disposed in said brackets; and
(c) said railing supported on said posts.

12. The apparatus of claim 2, further characterized by
(a) a folding ladder attached to said platform.

* * * * *